US006073566A

United States Patent [19]

Sahl

[11] Patent Number: 6,073,566

[45] Date of Patent: Jun. 13, 2000

[54] ATTACHMENT FOR SEWING MACHINES FOR TRIMMING THE MATERIAL TO BE SEWN

[76] Inventor: Johannes Sahl, Tannenweg 17, A-4501 Neuhofen, Austria

[21] Appl. No.: 09/232,984

[22] Filed: Jan. 19, 1999

[30] Foreign Application Priority Data

Feb. 2, 1998 [AT] Austria ..... 164/98

[51] Int. Cl.[7] ..... D05B 37/08

[52] U.S. Cl. ..... 112/122.3

[58] Field of Search ..... 112/122, 122.3, 112/122.1, 129, 130; 83/331, 332, 333, 910, 918, 936

[56] References Cited

U.S. PATENT DOCUMENTS

| | | | |
|---|---|---|---|
| 341,726 | 5/1886 | Borton | 112/122.3 |
| 2,105,184 | 1/1938 | Crewdson | 112/122.3 |
| 3,964,409 | 6/1976 | Mall et al. . | |
| 5,197,400 | 3/1993 | Prais . | |
| 5,813,356 | 9/1998 | Nolle | 112/122 |

FOREIGN PATENT DOCUMENTS

| | | |
|---|---|---|
| 322 954 | 8/1974 | Austria . |

*Primary Examiner*—Ismael Izaguirre
*Attorney, Agent, or Firm*—Collard & Roe, PC.

[57] ABSTRACT

An attachment (4) for sewing machines (1) for trimming the material to be sewn has a cutting tool comprising a blade (5) and a counter blade (6), which can be driven in dependence on the intermittent feed of the material to be sewn, and whose cutting plane (S) is aligned parallel to the feed. To achieve an inexpensive, space-saving and safe cutting of the material to be sewn, the cutting tool has a rotary blade (5) to be driven around an axis of rotation (D) normal to the cutting plane (S), which forms at least one cutting edge (7) extending only over part of the blade periphery and along its course deviates from a circular arc around the axis of rotation (D), and which rotates with a number of revolutions adapted to the feed of the material to be sewn indirectly proportional to the number of cutting edges.

3 Claims, 2 Drawing Sheets

ATTACHMENT FOR SEWING MACHINES FOR TRIMMING THE MATERIAL TO BE SEWN

1. Field of the Invention

This invention relates to an attachment for sewing machines for trimming the material to be sewn by means of a cutting tool comprising a blade and a counter blade, which can be driven in dependence on the intermittent feed of the material to be sewn, and whose cutting plane is aligned parallel to the feed.

2. Description of the Prior Art

For properly trimming the material to be sewn in feed direction in the course of a sewing operation, the cutting tool should only become effective when the material to be sewn is kept still for the impingement of the sewing needle due to the intermittent feed, whereby a pile-up and the like of the material to be sewn and related irregularities of the cut are prevented. Therefore, the cutting tools have so far all consisted of lifting blades movable up and down normal to the feed direction, which cooperate with stationary counter blades and during a standstill of the feed perform their working stroke cutting the material to be sewn together with a needle stroke, whereas during the return stroke they release the material to be sewn for the stepwise feed movement. However, these cutting tools are rather sluggish and limit the possible sewing speed, they involve a considerable constructional effort and require much space, and with their upper lifting blades associated to the lower counter blades, which are protruding above the platform and are movable up and down, they impair the guidance of the material to be sewn.

SUMMARY OF THE INVENTION

It is therefore the object underlying the invention to create an attachment as described above, which is characterized by its comparatively simple and space-saving cutting tool, whose cutting speed can also be adjusted to high sewing speeds.

This object is solved by the invention in that the cutting tool has a rotary blade to be driven about an axis of rotation normal to the cutting plane, which forms at least one cutting edge extending only over part of the blade periphery and in its course deviates from a circular arc about the axis of rotation, and which rotates with a rotational speed adapted to the feed of the material to be sewn indirectly proportional to the number of cutting edges. Due to the formation of a cutting edge deviating from a circular arc on a rotary blade, a cooperation of this cutting edge with an appropriate counter blade produces a drawing, scissors-like cut of predetermined length, which is defined by the relative movement of the cutting edge of the blade along the opposing cutting edge, where due to the shearing effect the material to be sewn is retained between the cutting edge of the blade and the opposing cutting edge, but then the material to be sewn is again freely movable and can be subjected to its feed steps. With a number of revolutions adjusted to the sewing feed and synchronized with respect to the feed steps, a rotary blade can therefore be used as part of the cutting tool, which not only leads to an economic and inexpensive construction, but also safely operates with virtually any cutting speed. As for every step a cutting edge of the blade must slide along the opposing cutting edge of the counter blade, the rotational speed of the rotary blade can be influenced by the number of the existing cutting edges in dependence on the feed or the number of stitches of the sewing needle, where the rotational speed decreases with increasing number of cutting edges. The cutting edges themselves are preferably rectilinear, but they might also extend in an arc, in order to take into account special cutting conditions, and the counter blade as well may form different opposing cutting edges adapted to the cutting edges of the blade, and it may be provided as fixed counter blade, but also as counter blade rotating in opposite direction as compared to the rotary blade. Due to the simple novel cutting tool concept it is easily possible to provide the fixed counter blade above the platform and the rotary blade below the platform, so that disturbing obstacles for the material to be sewn are avoided in the vicinity of the platform and the guidance of the material to be sewn is not impaired Since there is no lifting movement, even an inverse arrangement of blade and counter blade or a rotary counter blade creates no difficulties as regards the arrangement in the vicinity of the feed of the material to be sewn.

Favorable conditions in terms of cutting and feed technology are obtained when the rotary blade has at least two cutting edges uniformly distributed around the axis of rotation. There are obtained wing or disk blades, which due to their symmetry do not produce any imbalance and per number of revolutions ensure many cuts corresponding to the number of cutting edges, so that there is achieved a troublefree, hardly vibrating operation.

When the rotary blade basically has a square form and has four cutting edges extending along the sides of the square, cutting conditions are maintained, which are optimally adjusted to a sewing operation in terms of cutting edge guidance, length of cut, cutting and opening cycles and the like.

BRIEF DESCRIPTION OF THE DRAWING

In the drawing, the subject-matter of the invention is illustrated purely schematically, wherein.

DESCRIPTION OF THE PREFERRED EMBODIMENT

Figure 1:
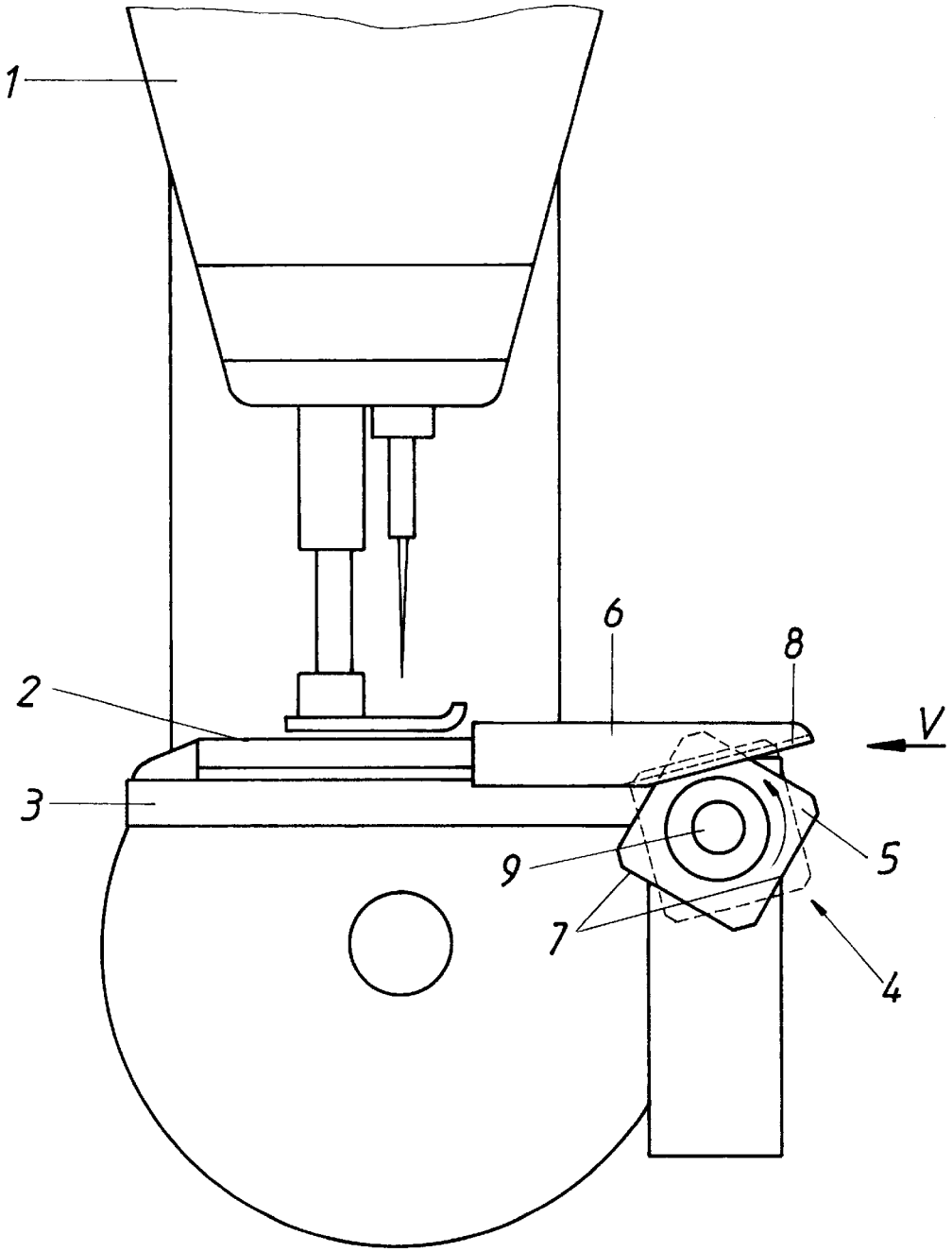
FIG. 1 shows a sewing machine with an inventive attachment in an end view.
Figure 2:
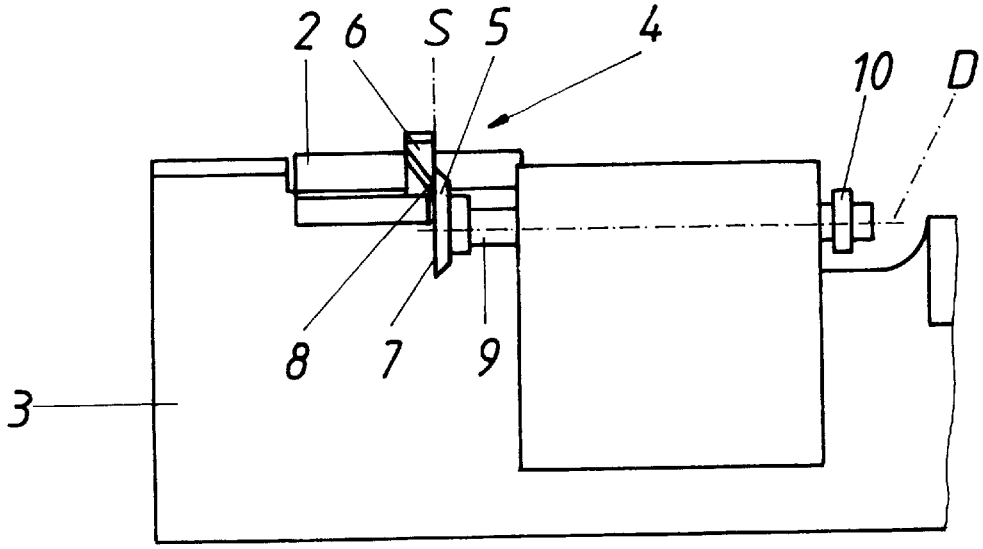
FIGS. 2 and 3 show part of the sewing machine with the attachment in a side view and in a top view o n an enlarged scale.
Figure 3:
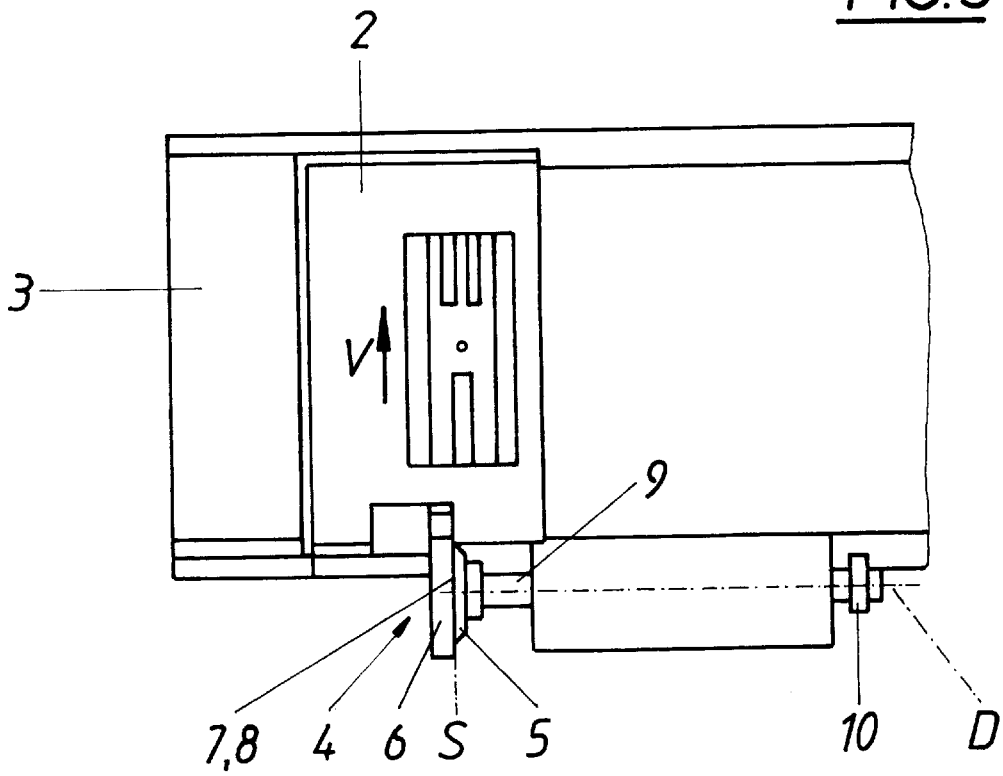

To be able to sew material to be sewn on a sewing machine 1 and trim the same in feed direction V in one working cycle, there is provided in feed direction before the needle plate 2 of the platform 3 an attachment 4, which comprises a cutting tool, whose cutting plane S is aligned parallel to the feed, including a lower rotary blade 5 disposed below the platform 3 and to be driven around an axis of rotation D normal to the cutting plane S, and an upper stationary counter blade 6. The rotary blade 5 basically is of square shape and forms four cutting edges 7 corresponding to the sides of the square, which cooperate with the opposing cutting edge 8 of the counter blade 6. Via a blade shaft 9, the rotary blade 5 is in drive connection with an only indicated transmission 10 and a drive shaft of the sewing machine 1 not represented in detail, and its rotational speed is adapted to the intermittent feed of the material to be sewn indirectly proportional to the number of cutting edges, thus corresponds for instance to the fourth part of the cutting frequency of the feed and thus the fourth part of the stitching frequency of the sewing needle. Due to this adjustment between rotational speed of the blade and intermittent feed, the material to be sewn is always retained only in the phase of standstill for the needle impingement between cutting edge 7 and opposing cutting edge 8, while after each step and before the following cutting edge becomes effective the material to be sewn is released and can be advanced for the next feed step.

There is obtained an inexpensive attachment 4 to be accommodated in a space-saving way, whose cutting tool provides for a safe trimming of the material to be sewn without impairing the guidance of the material to be sewn and with a cutting speed that can optimally be adapted to the possible sewing speeds and with perfect cutting conditions.

What is claimed is:

1. An attachment for a sewing machine for trimming a sheet material intermittently fed to the sewing machine along a cutting plane extending parallel to the direction of the intermittent feed, the attachment comprising a cutting tool which comprises (a) a rotary blade arranged to be driven about an axis of rotation extending perpendicularly to the cutting plane, the rotary blade (1) having at least one cutting edge extending only over a part of the rotary blade periphery and forming a course deviating from a circular arc around the axis of rotation during rotation of the rotary blade, and (2) rotating with a number of rotations adapted to the intermittent feed of the sheet material indirectly proportional to the number of cutting edges, and (b) a counter blade cooperating with the rotary blade to form a scissors with the rotary blade.

2. The attachment of claim 1, wherein the rotary blade has at least two cutting edges uniformly distributed over the rotary blade periphery.

3. The attachment of claim 2, wherein the rotary blade is of substantially square shape and has four cutting edges forming the sides of the square.

* * * * *